US005274971A

United States Patent [19]

Elmore et al.

[11] Patent Number: 5,274,971

[45] Date of Patent: Jan. 4, 1994

[54] RAPIDLY ERECTABLE, REMOVABLE, REUSABLE AND RAISABLE OUTDOOR ACOUSTICAL WALL SYSTEM AND METHOD

[75] Inventors: J. Thomas Elmore; Alan Veatch, both of Washington, D.C.; William C. Clements, Reston, Va.

[73] Assignee: JTE, Inc., Lorton, Va.

[21] Appl. No.: 935,895

[22] Filed: Aug. 28, 1992

[51] Int. Cl.[5] ..... E04B 1/82

[52] U.S. Cl. ..... 52/144; 52/766; 52/780; 181/284; 181/287

[58] Field of Search ..... 52/144, 275, 277, 766, 52/775, 780, 781, 169.2, 169.4; 181/210, 284, 287

[56] References Cited

U.S. PATENT DOCUMENTS

| | | | |
|---|---|---|---|
| 451,733 | 5/1891 | Leonard | 52/780 |
| 3,530,676 | 9/1970 | York . | |
| 3,800,494 | 4/1974 | Hall et al. . | |
| 3,948,009 | 4/1976 | Bernhard | 52/144 |
| 4,071,223 | 1/1978 | Demarest | 181/210 X |
| 4,837,993 | 1/1989 | Studenski . | |
| 5,003,742 | 4/1991 | Dettbarn . | |
| 5,079,885 | 1/1992 | Dettbarn . | |

*Primary Examiner*—Carl D. Friedman
*Assistant Examiner*—Creighton Smith
*Attorney, Agent, or Firm*—Sixbey, Friedman, Leedom, & Ferguson

[57] ABSTRACT

A rapidly erectable, removable, reusable, and raisable acoustical wall system is provided that comprises a plurality of wall panels, each of which has opposing side edges which include a front edge and a back edge, a plurality of panel support posts having pairs of parallel flanges for receiving the side edges of the wall panels to form a wall, and a plurality of wedging members for forcefully securing the front side edges of the panels into an acoustically-obstructing engagement with the front flanges of the panel support posts. Wedge-receiving recesses are provided at the top and bottom of each of the back side edges of the panels, the top recesses of one panel being registrable with the bottom recesses of another panel when two panels are stacked between the same support posts. Each wedging member is about the same length as two aligned wedge-receiving recesses so that a single wedging member may be used to forcefully engage the front side edges of two different panels against the front flanges of their respective support posts. In the method of the invention, the erection of the walls is expedited by the wedging members, which function to forcefully engage the bottom half of a wall panel into acoustically-obstructing engagement with its respective support post simply by the act of stacking one wall panel over another. Additionally, the resulting wall may be easily raised at another location by mounting extension members on the tops of the support posts, and sliding additional wall panels between the heightened posts.

35 Claims, 5 Drawing Sheets

RAPIDLY ERECTABLE, REMOVABLE, REUSABLE AND RAISABLE OUTDOOR ACOUSTICAL WALL SYSTEM AND METHOD

BACKGROUND OF THE INVENTION

This invention is generally concerned with wall erection systems and methods, and is specifically concerned with a rapidly erectable, removable, reusable and raisable post and panel-type acoustical wall system.

Acoustical wall systems for obstructing highway noises from residential areas are known in the prior art. Such wall systems generally take three different forms, including self-supporting walls, monolithic post and panel precast walls, and separate steel/concrete or wood post and panel precast walls. When viewed from above, self-supporting wall systems have an undulating profile which resembles a square or trapezoidal wave function which makes them self-supporting without the need for deep underground foundations. They are used where a flat and wide right-of-way is available on either side of the noise-generating highway, and where the ground provides good foundational support. Unfortunately, the larger amount of panel surface caused by the square or trapezoidal-wave profile of these walls necessitates 10% to 30% more structural and sound obstructive materials for their construction, which in turn causes them to be relatively expensive. Additionally, self-supporting wall systems are not compatible with certain desirable architectural wall finishes, and are difficult to install in terrain having significant relief. While self-supporting walls can be removed and reused, such removal and reuse is labor and equipment intensive. Finally, because of the section required to develop the weight required to be self-supporting, the economical height to which the wall can be raised is limited.

Monolithic pre-cast wall systems employ single-monolithic panels supported by concrete support columns integrally cast into the side edges of the panels. They are erected by tongue and groove connections between adjacent panels, and connections between the bases of the columns and a structural foundation is noramlly welded or bolted. While monolithic precast walls advantageously employ fewer amounts of wall panel materials than self-supporting walls, they are permanent structures which would be removable only with great difficulty with the help of large equipment requiring large amounts of working space. Additionally, these walls are not raisable or otherwise height-adjustable. Moreover, because the alignment of the joints between adjacent panels is dependent upon the grade of the specific terrain that the wall is initially erected on, it is difficult to re-use the same panels in a location having a different grade.

Post and panel acoustical walls employ panels that are slidably mounted between and supported by structurable independent support posts. The support posts are typically steel or concrete columns having opposing pairs of flanges which slidably receive the side edges of wall panels upon the raising of a panel by a crane above two adjacent support posts, and the subsequent lowering of the panel between the posts after the side edges are aligned between the flange pairs. Either a single panel or a stack of panels may be mounted between two adjacent posts. While post and panel walls have certain installation advantages over monolithic precast walls, they also have their disadvantages. One major disadvantage stems from the necessity of having to leave some amount of slack in the distance between the flanges of the supports posts and the thickness of the side edges so that the panels may be quickly aligned between the flanges of the beams prior to slidably lowering them between two flange pairs of adjacent posts. As a result of this slack, the front side edges of the panels cannot snugly engage the front flanges of their respective support posts, which if not corrected will create substantial acoustical leaks in the resulting wall, and poor structural alignment of the panels. In the past, this slack has been eliminated by the installation of steel angle members between the back flanges of the support posts and the back side edges of the panels to take up the unwanted slack in combination with the application of caulking between the panels and the posts. However, the installation of such steel angles has proven to be an expensive and time consuming step in the assembly of such wall systems, as it requires the drilling of a specific pattern of holes through the flanges of the I-beams forming the support posts, the regalvanization of the I-beams, as well as the tedious installation of several nuts and bolts for every angle in such a way that they continuously apply pressure to the back side edges of the panel. The materials cost is also substantial, not only with respect to the steel angles themselves, but the nuts and bolts necessary to mount them as well. Moreover, the use of such steel angle members sometimes fails to permanently remove unwanted slack between the front side edges of the panels and the flanges of the posts due to the constant vibration that such wall systems are subjected to due to their proximity to a heavy flow of road traffic. Vandals have occasionally been known to remove the nuts and bolts that secures the angle members in their place, which of course necessitates their replacement with its attendant expenses. Both the caulking of the panels and the posts and the installation of the numerous nuts and bolts used to mount the angle members substantially slows down both the raising and the disassembly of the wall system (should removal of the wall become desirable). Additionally, the custom pattern of bolt holes that must be drilled or molded in the flanges of each of the I-beams forming the posts makes it difficult, if not impossible, to reuse the same post structures should it become desirable to rebuild the wall system at a different location. The raising would require substantial reengineering of the post which has holes punched in the structural falgon.

Clearly, there is a need for an improved post and panel type acoustical wall system which overcomes all of the aforementioned disadvantages associated with the angle members used in prior art wall systems, and which provides an alternate means for removing unwanted slack between the back side edges of the panels and the flanges of the posts which does not impede the raising, disassembly or removability of the wall system. Ideally, such an alternative slack-removing means would not necessitate the drilling of a custom pattern of holes in the I-beams forming the posts so that the posts could be easily reused to build another wall system should it ever become desirable to remove or relocate the original wall system, and would further be durable, inexpensive, versatile, and not easily prone to destruction by either weather conditions or vandalism. The resulting wall systems should also be rapidly erectable, removable, and easily reusable, and raisable beyond the height of the originally-used posts to accommodate changes in the acoustical conditions surrounding the highway (which might occur, for example, if the highway were widened).

SUMMARY OF THE INVENTION

Generally speaking, the invention is a rapidly erectable, removable, reusable, and raisable post and panel-type acoustical wall system which overcomes all the aforementioned disadvantages by the use of wedging members which wedgingly and removably secure the side edges of the wall panels into acoustically obstructing engagement with the panel support posts. In the preferred embodiment, the wall panels are precast panels formed from a moldable material such as concrete, and each of the panels may include a front face over which a layer of acoustically obstructive material is placed. For a sound reflective wall system, this layer may simply be a finished concrete face. For a sound absorptive wall system, this layer may be a commercially available sound absorbing medium such as Durisol or Soundtrap/Soundlock. Each of the side edges of the wall panels preferably includes a planar front edge and a back edge, and the panel support posts are preferably formed from galvanized steel I-beams having two pairs of parallel flanges extending from a centrally disposed web. Each of the pairs of parallel flanges receives one of the side edges of the wall panels, and wedging members are inserted between the back side edges of the panels and the back flange of the beam forming the support post in order to snugly secure the planar front edges of each of the panels into acoustically obstructing engagement with the front flange of the beam.

The upper and lower ends of each of the back side edges of the panels includes a means for retaining one of the wedging members which preferably takes the form of a recess that is complementary in shape to the wedging member. These wedge-receiving recesses are positioned on the top and bottom ends of each of the back side edges such that they interconnect when one wall panel is slidably stacked over another wall panel between the same two I-beams, which advantageously allows a single wedging member to simultaneously force the front side edges of two different wall panels into acoustically obstructing engagement with the front flanges of the I-beams.

Preferably, the wedging members are formed from wood having compressive properties commensurate with the compressiveness of the sound-obstructing layer of material applied over the front faces of the wall panels. For example, if the front faces of the panels are covered with a relatively soft and compressible sound-absorbing material such Durisol, the wedges are preferably formed from a relatively soft wood such as pine, which is capable of partially yielding when forced in the recess of the wall panel between the back side edge and the back flange of the I-beam. Such properties will apply a continuous, pressure on the Durisol which will effectively seal out sound without crushing the Durisol. On the other hand, when the front face is merely finished concrete as would be the case with a sound reflective wall, a harder wedge formed from oak or other hard wood may be used. In all cases, the wedges are preferably pressure-treated to resist decay and insect attack. Alternatively, plastic foams of varying hardness may be used to form the wedging member.

In the method of the invention, a plurality of vertical-oriented support posts in the form of I-beams or precast columns are erected, these beams being spaced apart approximately the same distance as the width of the wall panels. Next, a wall panel as heretofore described is lifted above the ends of two adjacent I-beams, and the side edges are slidably inserted between the opposing pairs of flanges of each of the beams. After the panel lowering operation is completed for this first panel, a pair of wedging members is forcefully inserted into the wedge retaining recesses located at the top ends of each of the back side edges of the panel. The insertion operation wedgingly presses the front side edges of the wall panel into acoustically obstructing engagement with the front flanges of the two adjacent I-beams supporting it. As the length of each the wedging members is approximately twice the length of the recess in which it is inserted, the top ends of the two wedging members protrude upwardly above the top edge of the lowered panel. A second wall panel is then raised above the upper ends of the two adjacent I-beams, and lowered over the top edge of the bottommost wall panel. Because the topmost wall panel has wedge-receiving recesses on the bottom ends of its two back side edges which register with the recesses of the bottommost panel when the two are stacked together between the two support beams, the upper ends of the wedges already present in the recesses of the lower panel become forcefully inserted in the lower recesses of the topmost panel due to the weight of the topmost panel as it is being lowered. This mechanical action automatically causes the front face of the topmost panel to be forced into the front flanges of the two supporting I-beams in acoustically obstructing engagement. The two mutually registering recesses, in combination with the overlying back flange of the I-beams, positively captures the wedging member in such a manner that it will not fall out when the resulting wall is rattled from highway sound or wind, and affords so little access to the wedging member that it is difficult for vandals to remove them from an assembled wall.

To complete the assembly of the wall, the panel stacking and wedging member insertion operations are repeated until the wall is raised to a desired level.

To remove the resulting wall structure, all that is necessary to do is to reverse the assembly steps, i.e., remove the topmost wedge members located on the top side edges of the topmost wall panel, slidably remove the topmost wall panel from between the two adjacent I-beams by means of a crane, and then repeat the same steps until all of the panels and wedging members are removed. Preferably, I-beams that form the support post of the system are bolted onto pedestals by means of studs so that they can be conveniently removed and used in conjunction with the same wall panels and wedging members to rebuild the wall at a different location.

Because the use of the wedging members obviates the need to drill customized patterns of holes in the beams, beams from disassembled walls may be easily reused and even spliced together to raise the height of the reassembled wall.

BRIEF DESCRIPTION OF THE SEVERAL FIGURES

Figure 7:
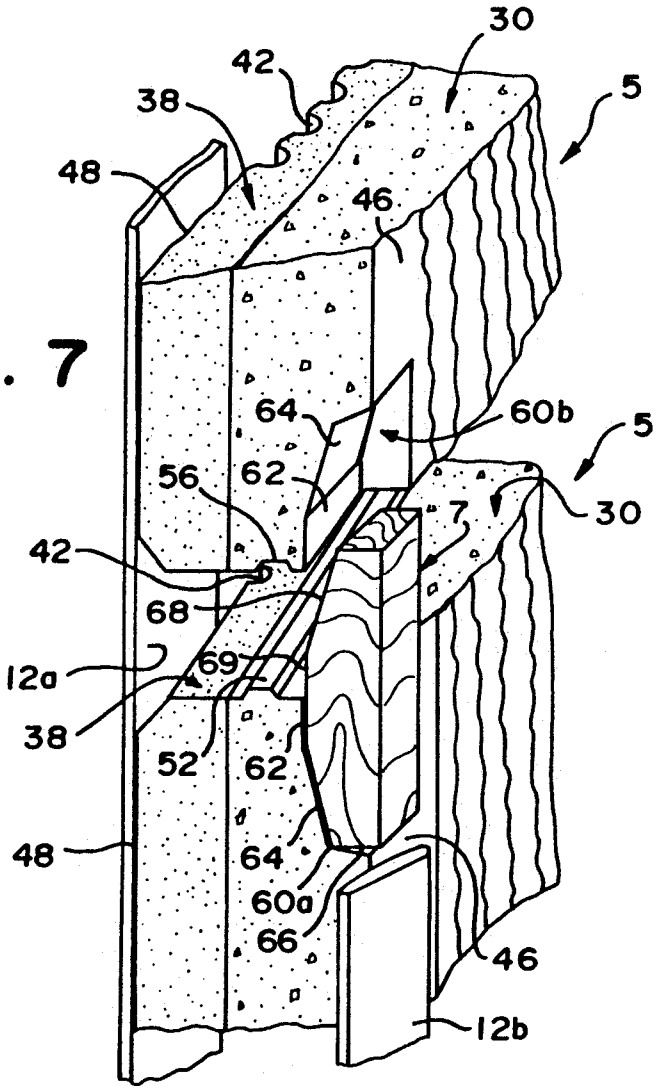
Figure 6:
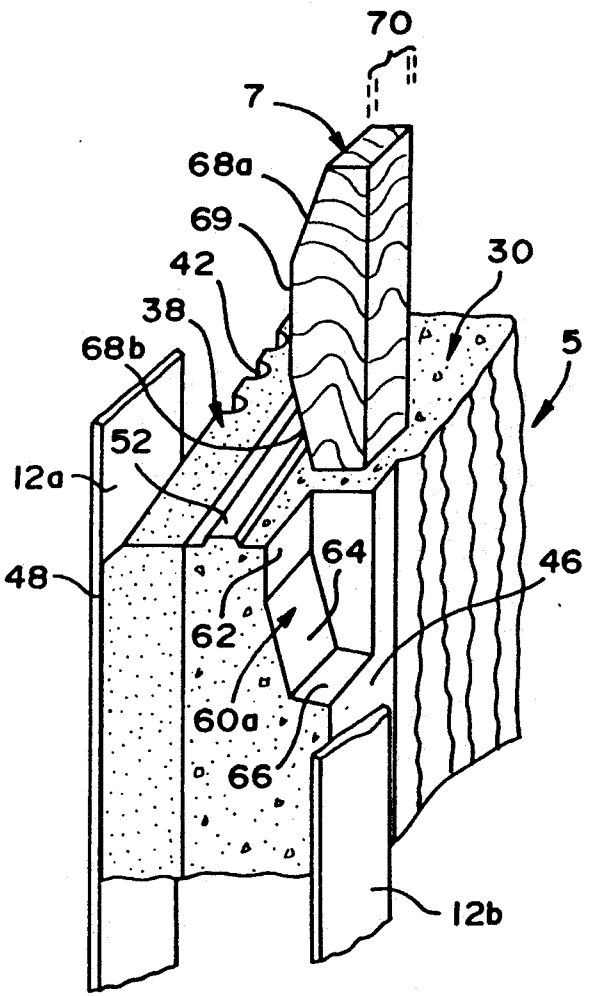
Figure 8:
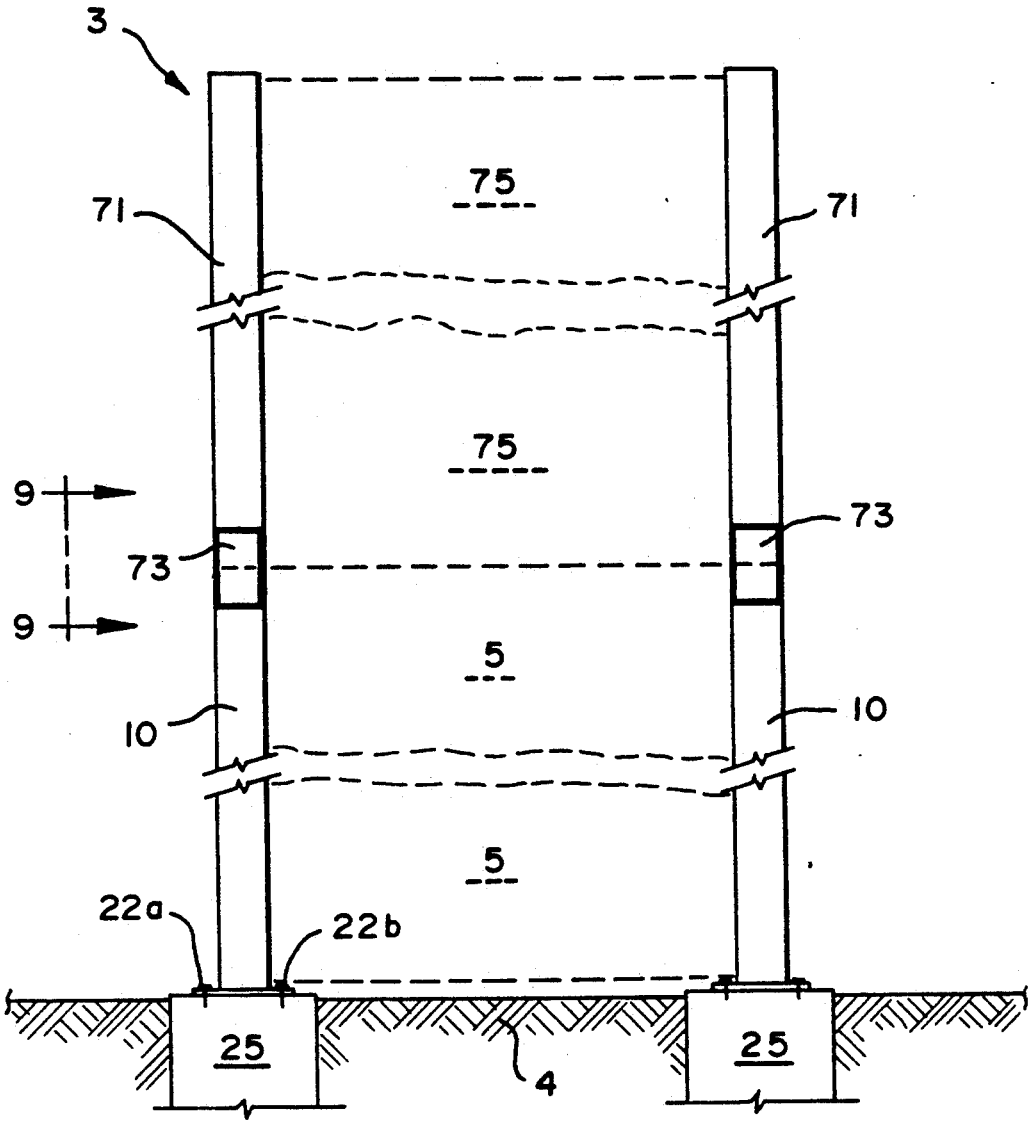
Figure 9:
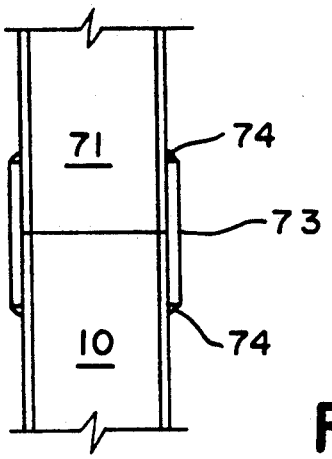

FIG. 6 is a perspective side view of one of the panels of the system, illustrating how the wedging member may be inserted into a complementarily shaped wedge-receiving recess in order to snug the front side edge of the panel into acoustically obstructing engagement with the front flange of one of the posts, and FIG. 7 is a side perspective view of one panel being lowered in stacked relationship on top of another panel, illustrating how the protruding top end of the wedging member will automatically be received within the recess of the topmost panel in order to force its front side edges into engagement with the front flange of the post merely by lowering the upper panel on top of the lower panel;

FIG. 8 is a side view of the wall system of the invention, illustrating how the posts may be extended in order to raise the height of a reassembled wall, and FIG. 9 is a side view of one of the posts illustrated in FIG. 8 along the line 9—9, illustrating how extensions to the posts may be spliced on.

DETAILED DESCRIPTION OF THE PREFERRED EMBODIMENT

Figure 1A:
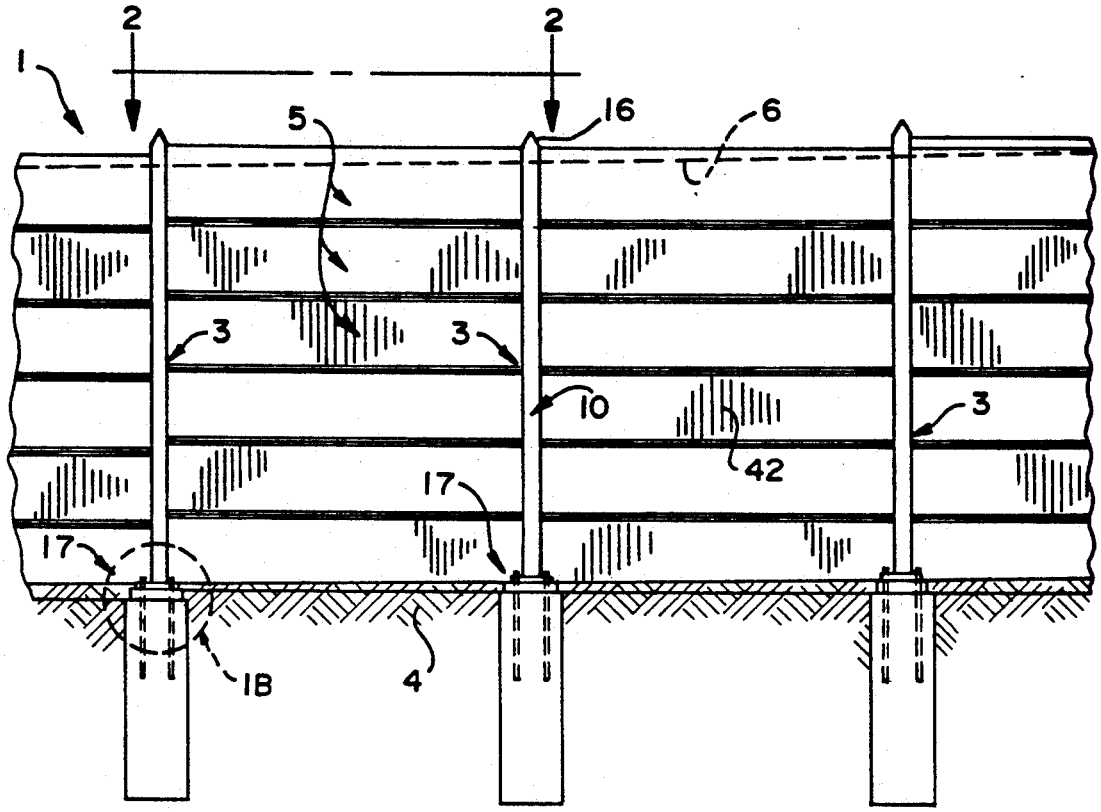
FIG. 1A is a side view of the acoustical wall system of the invention as it appears assembled into a wall, with the base assemblies of the post shown uncovered.
Figure 2:
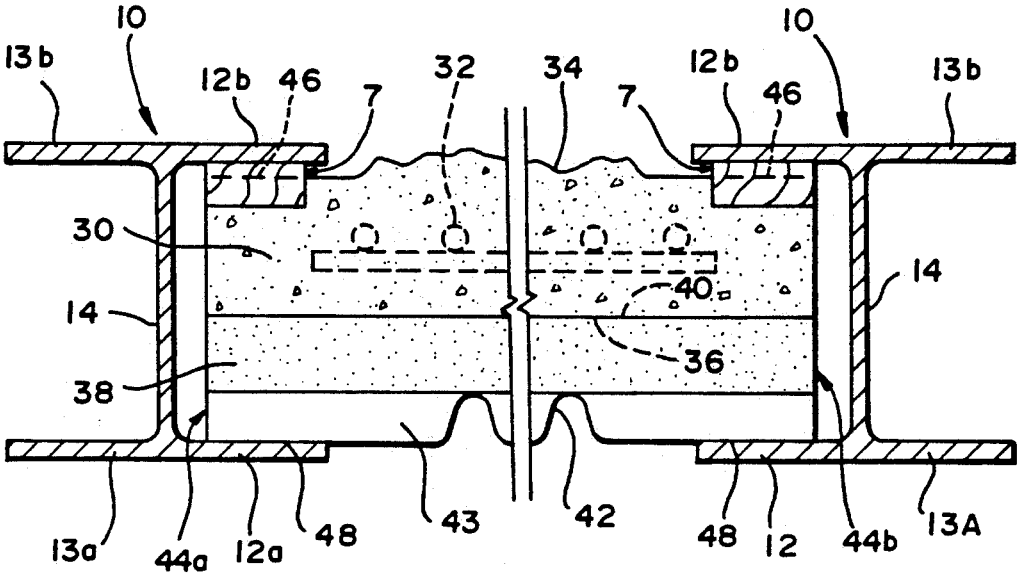
FIG. 2 is a plan view of the wall system illustrated in FIG. 1A along the line 2—2.
Figure 1B:
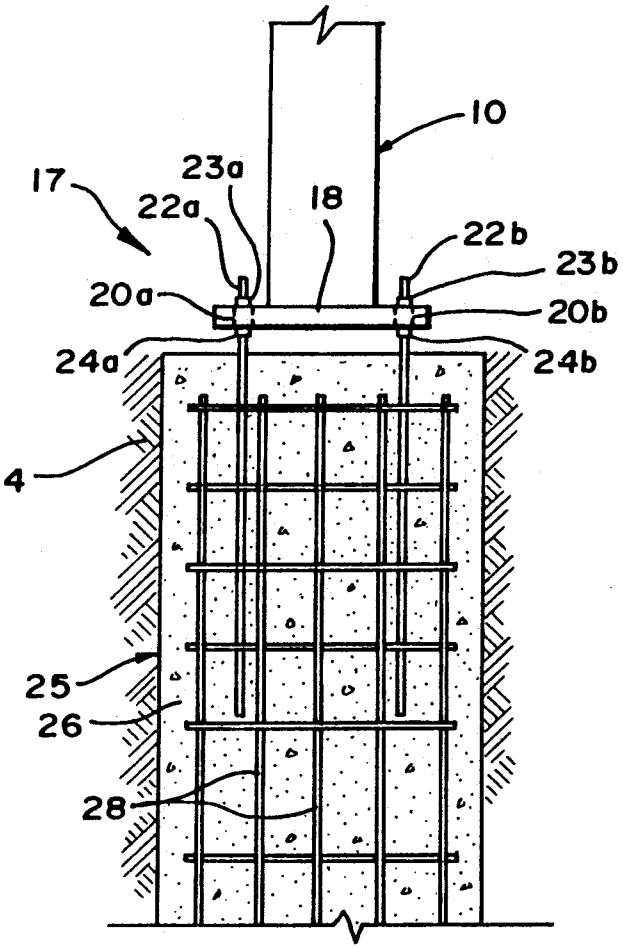
FIG. 1B is a cross-sectional side view of the base assembly circled in phantom in FIG. 1A.

With reference now to FIGS. 1A, 1B and 2, the acoustical wall system 1 of the invention generally comprises a plurality of post assemblies 3 vertically mounted in the ground 4, as well as a plurality of precast panels 5 which are stacked between the post assemblies 3 to a height 6 which is great enough to prevent unwanted noise from a highway from directly impinging on a group of residences or other buildings (not shown). As will be discussed in more detail hereinafter, slack between side edges of the panels 5 and the space between the parallel flanges of the beams forming the post assemblies 3 is expeditiously taken out by a plurality of wedge members 7 which serve to snug the front faces of the panels 5 into acoustically obstructing engagement with the front flanges of the posts 3.

With specific reference now to FIG. 2, each of the post assemblies 3 is formed from an I-beam 10 having two pairs of opposing flanges 12*a,b* and 13*a,b* extending from a center web 14. The I-beam 10 may be galvanized steel, weathered steel or concrete. The top of the flanges of each of the beams 10 includes a taper 16 to facilitate the alignment of the side edges of the panels 5 within the flange pairs 12*a,b* and 13*a,b*. With specific reference now to FIG. 1B, the bottom ends of each of the beams 10 includes a base assembly 17. The base assembly 17 is formed from a square base plate 18 welded to the bottom of the beams 10, which includes four stud holes 20*a–d*, of which only holes 20*a* and 20*b* are shown. The holes 20*a–d* receive studs or anchor bolts 22*a–d*, and the base plate 18 is secured onto the studs by means of upper and lower nuts 23*a–d* and 24*a–d* as shown. The studs 22*a–d* extend down into and are secured within a pedestal 25 formed from a rectangular block of concrete 26 reinforced by a network 28 of steel bars. The use of studs and nuts to secure the bottom ends of the beams 10 onto the pedestal 25 not only allows the beams to be easily secured to and removed from the pedestals 25 incident to wall assembly and removal operations, but further provides a means for adjusting the vertical orientation of the beams 10 so that they are substantially plumb prior to the lowering of the wall panel 5 into the flange pairs 12*a,b* and 13*a,b*.

Figure 4:
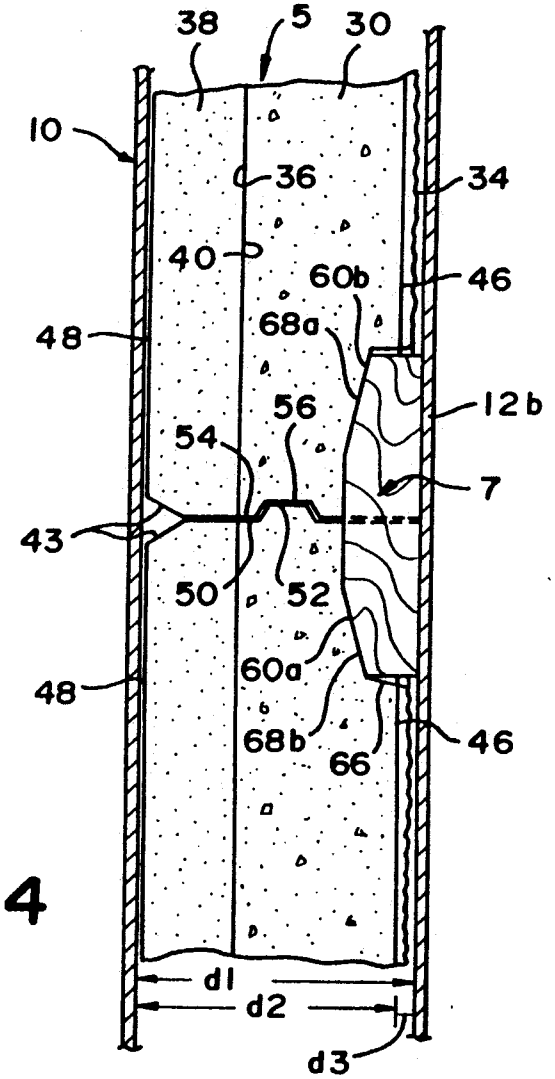
FIG. 4 is a side, cross-sectional view of the partial wall section illustrated in FIG. 3 along the line 4—4, illustrating how a single wedging member is received within adjacent, wedge-receiving recesses in different wall panels.
Figure 3:
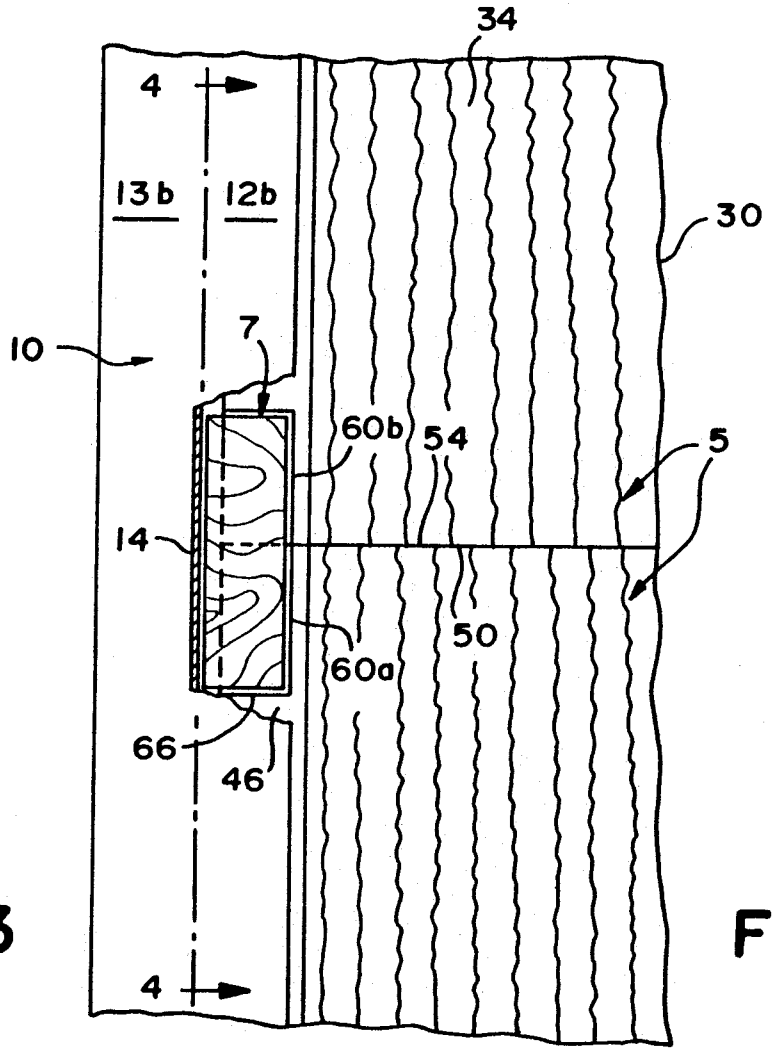
FIG. 3 is a partial back view of the wall system illustrated in FIG. 1A with part of the back flange of the post broken away so that the wedging member of the system may be more plainly seen.

With reference now to FIGS. 2, 3, and 4, each of the panels 5 of the wall system 1 includes a support layer 30 of precast concrete strengthened by a network of reinforcing steel 32. The back surface 34 may have a rough or rake finish, while the front surface 36 is substantially flat. In the preferred embodiment, the front surface 36 of the support layer 30 is covered by a layer 38 of sound absorbing material such as Durisol (available from the Reinforced Earth Company located in Vienna, Va.), or Soundtrap (available from Smith Midland Corporation located in Midland, Va.). Both materials are porous, compressible compositions formed in part by concrete having large amounts of air void spaces. The sound absorbing layer 38 includes a flat back surface 40 which overlies the flat front surface 36 of the support layer 30 as well as a fluted front surface 42 for absorbing sound. The front surface 42 of the sound absorbing layer 30 is circumscribed by a bevel 43 as shown. Each of the panels 5 includes a pair of opposing side edges 44*a,b* having a generally planar back side edge 46, and planar front side edge 48. The top edge 50 of each of the panels 5 includes a sound obstructing key 52 which fits into a keyway 56 located at the bottom edge 54 of another panel 5 when two panels are stacked together as shown in FIG. 4. In addition to sound obstruction, the interfitting key 52 and keyway 56 further help to rigidify the wall resulting from the assembly of the wall system 1.

Figure 5:
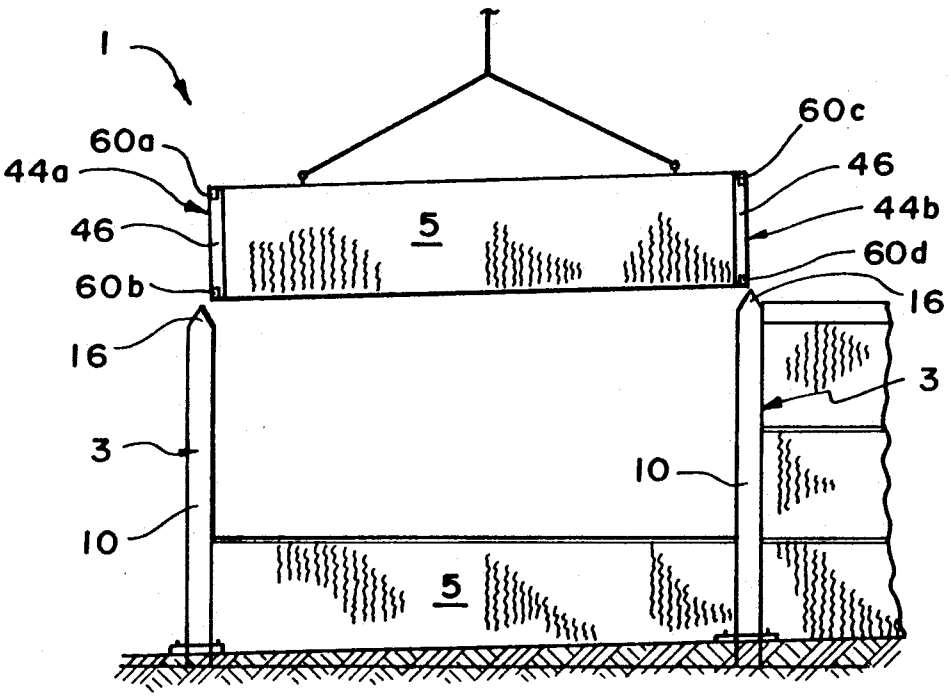
FIG. 5 is a back view of the wall system of the invention illustrating the method of assembly.

With reference now to FIGS. 3, 4, 5, and 6, both the top and bottom ends of each of the planar back side edges 46 of every panel 5 includes recesses 60*a,b* whose general locations are best seen with respect to FIG. 5. Each of the recesses 60*a,b* includes a flat upper section 62 bordered by a tapered wall 64 which are generally complementary to the lower half of a wedging member 7. The recesses 60*a* located on the upper ends of the planar back side edges 46 terminate in a bottom wall 66 which is slightly inclined relative to the horizontal so as to allow rain water which could otherwise soak the wooden wedge 7 to drain out of the recess 60A.

As best seen in FIGS. 4 and 5, each of the wedging members 7 includes upper and lower tapered wedging surfaces 68*a,b* which are complementary in shape to the tapered walls 64 of upper and lower recesses 60*a,b*. The front portion of each of the wedging members 7 further includes a flat surface 69 which is approximately twice as long as the flat section 62 of either of the upper or lower recesses 60*a,b*. Finally, the back of the wedging member 7 includes a spacer portion generally indicated at 70 which is dimensioned to insure that when the wedging member 7 is inserted between the back flange 12B of a beam 10 and two mutually registering upper and lower recesses 60*a,b* of two different panels, the member 7 will apply a force sufficient to snug the planar front side edges 48 of the panel 5 into acoustically obstructing engagement with front flange 12*a* of the beam 10. The wedging member 7 is preferably formed from a material with similar compressive properties as the material forming the front face of the panel 5. Hence, when a layer of relatively soft and brittle sound absorbing material 38 is applied over the front of the panel 5, the wedging member 7 is preferably formed from a soft and yielding wood, such as pine. Alternatively, if the front face of the panels 5 is formed from a relatively hard, sound reflective material such as smoothly finished concrete (as would be the case if the wall system 1 were used to erect a sound reflective wall) the wedging member 7 is preferably formed from a hardwood such as oak or maple. In all cases where wood is used to form the wedging member 7, the wood is preferably pressure treated with aluminum salts to increase the members resistance to insects or fungi. In all instances, the spacer portion 70 of the wedging member 7 is dimensioned to provide a snug engagement between the front side edges 46 of the panels 5 and the front flanges 12*a* of the beams 10 forming the post assemblies 3. Specifically, as is shown in FIG. 4, if the distance between flanges 12*a,b* is d1, and the distances between the front and back side edges 46 and 48 of the panel is d2, then the spacer portion 70 of the wedging member 7 will be dimensioned so that it is slightly larger than d3, the difference between d1 and d2.

The method of the invention is best understood with reference to FIGS. 5, 6, and 7. In the first step of the method of the invention, the pedestals 25 of the base assembly 17 of each of the post assemblies 3 are constructed by first augering an appropriately dimensioned hole in the earth 4, and then casting the previously described steel-reinforced, cylindrical block of concrete 26 with the studs 22 extending slightly above the ground. Next, the beams 10 of the post assemblies 3 are secured onto the pedestals 25 by means of the previously described upper and lower nuts 23*a–d* and 24*a–d*. During this step, each of the beams 10 is accurately vertically positioned until it is plumb with respect to the surrounding ground. The pedestals 25 are spaced apart such that when the beams 10 are plumbly installed, the distance between the center webs 14 of adjacent beams 10 is only slightly wider than the width of the panels 5.

In the next step of the method, the side edges 44*a,b* of a first panel are aligned between opposing parallel flanges 12*a,b* of two adjacent beams 10 and then slid down to the bottom of the beams 10 as shown by means of a crane (not shown). This step is facilitated by the tapered end 16 of the flanges present at the top ends of each of the two adjacent beams 10.

Next, the bottom portions of two wedging members 7 are inserted in the upper recesses 60*a* existing on either side of the top edge of the lower panel 5, as shown in FIGS. 6 and 7. Such insertion of each of the wedging members 7 has the effect of snugging the front side edge of the panel 5 against the front flange 12*a* in the manner previously described, while at the same time securely capturing the lower half of the wedging member 7 between the tapered wall 64 of the recess 60*a* and the back surface of the back flange 12*b* (as is best seen in FIG. 4).

A second panel 5 is next raised above the upper ends of the beams 10 of the adjacent post assemblies 3, as is shown in FIG. 5. The side edges 44*a,b* are again aligned between the pairs of adjacent flanges 12*a,b* of the two adjacent beams 3 with the help of the previously described tapers 16, and a second panel 5 is slid on top of the first installed panel 5. Just before the bottom edge 54 of the second panel 5 engages the top edge 50 of the bottommost panel 5, the upper portion of the wedging member 7 is received by the bottom recess 60*b* of the topmost panel, which automatically creates a wedging action which in turn snugs the front side edge 48 of the topmost panel 5 into engagement with the back surface of the top flange 12*a* as is best seen in FIGS. 4 and 7. All of the aforementioned panel raising and lowering steps are repeated until the wall created by the wall system 1 is complete.

With reference now to FIGS. 8 and 9, the wall of the system 1 can be conveniently raised at another location in response to changing acoustical conditions which may happen if, for example, the highway that the wall is next to is widened. It would further be possible to raise the wall system at the same location so long as the load capacity of the existing pedestals 25 and studs or anchor bolts 22*a–d* would not be exceeded. To raise the wall, post extensions 71 may be connected over the top ends of the beams 10 by splicing plates 73, which are secured to both the beam 10 and extension by means of welds 74. The extensions 71 may be formed from portions of steel beams which are identical in structure to the beams 10 initially erected, but the bottom beam may be larger in section if required to meet the structural requirement need for the additional height. Additional panels 75 may then be stacked over the former topmost panel 5 in the same manner as previously described.

To remove the wall created by the system 1, all of the aforementioned method steps are repeated in reverse. The resulting plurality of beams 10, wedging members 7, and panels 5 can then be conveniently reused to build another wall at another location.

While both the system and method of this invention has been described with respect to a preferred embodiment, a number of substitutions of equivalent components and variations of similar method steps will become evident to the person of ordinary skill in the construction arts. All such substitutions and variations and equivalents thereof are encompassed within the scope of this invention, which is limited only by the claims appended hereto.

We claim:

1. A rapidly erectable, removable and raisable post and panel outdoor acoustical wall system comprising:

at least first and second wall panels, each of which includes spaced, opposed first and second faces bordered by a panel top edge, a panel bottom edge, and first and second, spaced panel side edges extending between said panel top and bottom edges;

first and second spaced, elongate panel support posts each having spaced first and second flanges which define a longitudinally extending slot for receiving a side edge of said first and second wall panels, the longitudinally extending slot in said first panel support post receiving the first side edges of said first and second wall panels with the first and second flanges thereof overlying the first and second faces respectively of said first and second wall panels in a first area adjacent to said first side edge thereof, and the longitudinally extending slot in said second panel support post receiving the second side edges of said first and second wall panels with the first and second flanges thereof overlying the first and second faces respectively of said first and second wall panels in a second area adjacent to said second side edges thereof, said second wall panel being received in the longitudinally extending slots of said first and second panel support posts with the bottom edge thereof in contact with the top edge of said first wall panel;

said first wall panel including a top recess formed in the first face thereof in each of said first and second areas, each of said top recesses being in the form of an open channel extending downwardly from the top edge of said first wall panel and having an end opening at said top edge, and said second wall panel including a bottom recess formed in each of the first and second areas of the first face thereof to be coextensive with the top recesses in said first wall panel when the first and second wall panels are mounted in the longitudinally extending slots in said panel support posts, each of said bottom recesses being in the form of an open channel extending upwardly from the bottom edge of said second wall panel and having an end opening at said bottom edge, and a removable wedging means mounted in each of the coextensive top and bottom recesses of said first and second wall panels to engage the first flanges of said first and second support posts to force the first and second areas of the second faces of said first and second wall panels which are opposite to said top and bottom recesses against the second flanges of said panel support posts.

2. The rapidly erectable, removable and raisable post and panel outdoor acoustical wall system according to claim 1 wherein said wedging means are single elongate wedges, one of which is mounted in each of the coextensive recesses in the first and second areas of said first and second wall panels, each of said elongate wedges extending from the top recess in said first wall panel outwardly from the open channel end thereof into the coextensive bottom recess in said second wall panel.

3. The rapidly erectable, removable and raisable post and panel outdoor acoustical wall system according to claim 2 wherein each of said elongate wedges includes a flat surface for engaging said first flange and a tapered surface at each end thereof opposite to said flat surface, one such tapered surface extending into the top recess in said first wall panel and the second tapered surface extending into the bottom recess in said second wall panel.

4. The rapidly erectable, removable and raisable post and panel outdoor acoustical wall system according to claim 3 wherein the open channels of said coextensive top and bottom recesses in said first and second wall panels each include a tapered wall portion that is substantially complementary in shape to the tapered surface of the elongate wedge which extends into such recess, the tapered surface at each end of the elongated wedge engaging the tapered surface of a channel wall portion.

5. The rapidly erectable, removable and raisable post and panel outdoor acoustical wall system of claim 1 wherein the open channels of said coextensive top and bottom recesses in said first and second wall panels each include an end wall spaced from the open end of said channels and a tapered wall portion for engaging said wedging means, said tapered wall portion being inclined from said end wall toward the second face of the respective first or second wall panel.

6. The rapidly erectable, removable, reusable and raisalbe post and panel outdoor acoustical wall system according to claim 1 wherein said second face of said first and second wall panels includes a layer of sound obstructing material which extends substantially across said second face between the first and second side edges thereof.

7. The rapidly erectable, removable, reusable and raisable post and panel outdoor acoustical wall system according to claim 1 wherein the open channels of said coextensive top and bottom recesses in said first and second wall panels each include an end wall spaced from the open end of said channel, the end walls of channels forming the top recesses in said first wall panel being inclined, inwardly from said first face toward said top edge of said first wall panel.

8. The rapidly erectable, removable, reusable and raisable post and panel outdoor acoustical wall system according to claim 1 wherein the top edge of said first wall panel and the bottom edge of said second wall panel are formed to provide a tongue and groove connection between said first and second wall panels.

9. A rapidly erectable, removable, reusable, and raisable post and panel outdoor acoustical wall system according to claim 6, wherein said layer of sound obstructing material on said front face of said wall panels is compressible sound absorbing material, and the force applied by said wedging means is sufficient to create said sound obstructing engagement without breaking said sound absorbing material.

10. A rapidly erectable, removable, reusable, and raisable post and panel outdoor acoustical wall system according to claim 9, wherein said wedging means includes a wedging member formed from a material having substantially similar compressive properties as said sound absorbing material to prevent the breakage of said material.

11. A rapidly erectable, removable, reusable, and raisable post and panel outdoor acoustical wall system according to claim 10, wherein each said wall panel is formed from a castable material that hardens into a brittle solid, and wherein the compressibility of said sound absorbing material and the material forming said wedging member helps to prevent the brittle, castable material in the panel from cracking when said wedging members are mounted to apply said wedging force between panels and said flanges of said posts.

12. A rapidly erectable, removable, reusable, and raisable post and panel outdoor acoustical wall system according to claim 10, wherein said wedging member is formed from wood.

13. A rapidly erectable, removable, reusable, and raisable post and panel outdoor acoustical wall system according to claim 10, wherein said sound absorbing material is selected from one of the group consisting of Durasol or Soundtrap, and the wedging member is formed from pine.

14. A rapidly erectable, removable, reusable, and raisable post and panel outdoor acoustical wall system according to claim 6, wherein said layer of sound obstructing material is a sound reflective material, and wherein said wedging means includes a wedging member formed from a material having similar compressive characteristics as said sound reflective material.

15. A rapidly erectable, removable, reusable, and raisable post and panel outdoor acoustical wall system according to claim 14, wherein said sound obstructing material is concrete, and said wedging member is formed from hardwood.

16. A rapidly, erectable, removable, reusable, and raisable post and panel outdoor acoustical wall system according to claim 1, further including post extension members, and means for mounting said extension members on the tops of said support posts to raise the height of the wall formed by said system.

17. A rapidly erectable, removable, reusable and raisable post and panel outdoor acoustical wall system comprising:

at least first and second wall panels, each of which includes spaced, opposed first and second faces bordered by a panel top edge, a panel bottom edge and first and second panel side edges extending between said panel top and bottom edges, first and second spaced, elongate panel support posts each having spaced first and second flanges which define a longitudinally extending slot for receiving a side edge of said first and second panels, the longitudinally extending slot in said first panel support post receiving the first side edges of said first and second wall panels with the first and second flanges thereof overlying the first and second faces respectively of said first and second wall panels in a first area adjacent to said first side thereof, and the longitudinally extending slot in said second panel support post receiving the second side edges of said first and second wall panels with the first and second flanges thereof overlying the first and second faces respectively of said first and second wall panels in a second area adjacent to said second side edges thereof, said second wall panel being received in the longitudinally extending slots of said first and second panel support posts with the bottom edge thereof in contact with the top edge of said first wall panel;

and separate removable wedging means mounted between said first and second wall panels and said first and second elongate panel support to extend substantially parallel to said support posts in the first and second areas of each of said first and second wall panels adjacent to the top edge of said first wall panel and adjacent to the top and bottom edges of said second wall panel, said wedging means extending between and engaging the first face of said first and second wall panels and the first flanges of said first and second support posts to force the second face of said first and second wall panels against the second flanges of said panel support posts.

18. A rapidly erectable, removable, reusable and raisable post and panel outdoor acoustical wall system according to claim 17 wherein said wedging means force the first and second wall panels into acoustically obstructing engagement with said second flanges of said panel support posts.

19. A rapidly erectable, removable, reusable and raisable post and panel outdoor acoustical wall system according to claim 18 wherein said wedging means includes elongate wedges, each of which engages both the first face of said first wall panel adjacent to the top edge thereof and extends beyond said top edge of said first wall panel to engage the first face of said second wall panel adjacent to the bottom edge thereof.

20. A rapidly erectable, removable, reusable and raisable post and panel outdoor acoustical wall system according to claim 19 wherein each of said elongate wedges includes a flat surface for engaging said first flange and a tapered surface at each end thereof opposite to said flat surface, one such tapered surface engaging said first wall panel and the second tapered surface engaging said second wall panel.

21. A rapidly erectable, removable, reusable and raisable post and panel outdoor acoustical wall system according to claim 18 wherein said second face of said first and second wall panels includes a layer of compressible sound absorbing material which extends substantially across said second face between the first and second edges thereof, said wedging means creating sufficient force between said sound absorbing material and said second flanges of said first and second support posts to create a sound obstructing engagement therebetween without substantially breaking said sound absorbing material.

22. A rapidly erectable, removable, reusable and raisable post and panel outdoor acoustical wall system according to claim 21 wherein said wedging means are formed of material having substantially similar compressive properties to those of said sound absorbing material to prevent breakage of said sound absorbing material.

23. A rapidly erectable, removable, reusable and raisable post and panel outdoor acoustical wall system according to claim 18 wherein said wedging means include wedges formed of wood.

24. A rapidly erectable, removable, reusable and raisable post and panel outdoor acoustical wall system according to claim 17 wherein the first face of said first and second wall panels is formed with a plurality of wedge receiving means for receiving and retaining said wedging means.

25. A rapidly erectable, removable, reusable and raisable post and panel outdoor acoustical wall system comprising:

a wall panel which includes spaced, opposed first and second faces bordered by a panel top edge, a panel bottom edge and first and second spaced panel side edges extending between said panel top and bottom edges, said wall panel including a supporting layer of precast concrete forming said first face and a layer of sound absorbing material formed on said supporting layer to form said second face.

first and second spaced, elongate panel support posts each having spaced first and second flanges which define a longitudinally extending slot for receiving a side edge of said wall panel, the longitudinally extending slot in said first panel support post receiving the first side edge of said wall panel with the first and second flanges thereof overlying the first and second faces of said wall panel in a first area adjacent to said first side edge, and the longitudinally extending slot in said second panel support post receiving the second side edge of said wall panel with the first and second flanges thereof overlying the first and second faces of said wall panel in a second area adjacent to said second side edge, and removable elongate wedging means mounted between said wall panel and said first and second elongate panel support posts in the first and second areas adjacent to the top edge of said wall panel and in the first and second areas adjacent to the bottom edge of said wall panel to extend substantially parallel to said first and second support posts, said wedging means extending between and engaging the first face of said wall panel and the first flanges of said first and second support posts and being formed from material of sufficient rigidity to force the second face of said wall panel into acoustically obstructing engagement against the second flanges of said panel support posts.

26. A rapidly erectable, removable, reusable and raisable post and panel outdoor acoustical wall system comprising:

a wall panel which includes spaced, opposed first and second faces bordered by a panel top edge, a panel bottom edge and first and second spaced panel side edges extending between said panel top and bottom edges, said wall panel including a plurality of wedge receiving means formed in said first face thereof, first and second spaced, elongate panel support posts each having spaced first and second flanges which define a longitudinally extending slot for receiving a side edge of said wall panel, the longitudinally extending slot in said first panel support post receiving the first side edge of said wall panel with the first and second flanges thereof overlying the first and second faces of said wall panel in a first area adjacent to said first side edge, and the longitudinally extending slot in said second panel support post receiving the second side edge of said wall panel with the first and second flanges thereof overlying the first and second faces of said wall panel in a second area adjacent to said second side edge, and removable elongate wedging means mounted between said wall panel and said first and second elongate panel support posts in the first and second areas adjacent to the top edge of said wall panel and in the first and second areas adjacent to the bottom edge of said wall panel to extend substantially parallel to said first and second support posts, the wedge receiving means formed for receiving and retaining said removable wedging means said wedging means extending between and engaging the first face of said wall panel and the first flanges of said first and second support posts to force the second face of said wall panel against the second flanges of said panel support posts.

27. A rapidly erectable, removable, reusable and raisable post and panel outdoor acoustical wall system according to claim 26 wherein said wedge receiving means are formed in the first and second areas of said first face adjacent to both the top and bottom edges of the wall panel, the wedge receiving means in said first area adjacent to the top and bottom edges of the panel being substantially aligned and the wedge receiving means in said second area adjacent to the top and bottom edges of the panel being substantially aligned.

28. A rapidly erectable, removable, reusable and raisable post and panel outdoor acoustical wall system according to claim 26 wherein said wedge receiving means include a top recess formed in the first face of said wall panel in each of said first and second areas, each of said top recesses being in the form of an open channel extending inwardly from the top edge of said wall panel and having an end opening at said top edge, and a bottom recess formed in the first face of said wall panel in each of said first and second areas, each said bottom recess being in the form of an open channel extending inwardly from the bottom edge of said wall panel and having an end opening at said bottom edge.

29. A rapidly erectable, removable, reusable and raisable post and panel outdoor acoustical wall system according to claim 28 wherein the open channels of said top and bottom recesses each include a tapered wall portion to engage said wedging means.

30. An outdoor acoustical wall panel for use with first and second panel support posts each having spaced first and second flanges which define a longitudinally extending slot for receiving a side edge of said wall panel and separate, removable wedges to engage one face of the panel and the first flange of a support post and force a second opposed face of said panel into acoustically obstructing engagement with the second flange of said support post, said wall panel comprising:

opposed first and second faces bordered by a top edge, a bottom edge and first and second side edges, first and second top wedge receiving recesses formed in the first face of said panel adjacent to said first and second side edges respectively, each of said top wedge receiving recesses being in the form of an open channel extending inwardly from said top edge and having an end opening at said top edge, and first and second bottom wedge receiving recesses formed in the first face of said panel adjacent to said first and second side edges respectively, each of said bottom wedge receiving recesses being in the form of an open channel extending inwardly from said bottom edge and having an end opening at said bottom edge, the open channels of said top and bottom wedge receiving recesses each including a tapered wall to receive a wedge, said first top and bottom wedge receiving recesses being in substantial alignment and said second top and bottom wedge receiving recesses being in substantial alignment.

31. An outdoor acoustical wall panel according to claim 30 wherein the open channels of said top and bottom wedge receiving recesses each include an end wall spaced from the open end of said channel, said tapered wall portion being inclined from said end wall toward the second face of said wall panel.

32. An outdoor acoustical wall panel according to claim 31 wherein the end wall of the channel for said first and second top wedge receiving recesses is inclined toward said bottom edge and the end wall of the channel for said first and second bottom wedge receiving recesses is inclined toward said top edge.

33. An outdoor wall panel according to claim 31 wherein said second face includes a layer of sound obstructing material that extends substantially to the first and second side edges thereof.

34. An outdoor acoustical wall panel according to claim 33 which includes a precast layer and wherein said layer of sound obstructing material is a sound absorbing material.

35. An outdoor acoustical wall panel according to claim 34 wherein said wall panel is formed from a castable material that hardens into a brittle solid, said layer of sound absorbing material being formed of compressible material.

* * * * *